United States Patent [19]

Brienza et al.

[11] Patent Number: 4,950,155

[45] Date of Patent: Aug. 21, 1990

[54] REPLACEABLE LONGITUDINAL SEAL FOR A ROTARY COMBUSTOR

[75] Inventors: Anthony R. Brienza, Orange, Calif.; Cazmier L. Liszewski, Smithton, Pa.; Richard R. Harloff, Monroeville, Pa.; William F. Garland, Manchester, Pa.

[73] Assignee: Westinghouse Electric Corp., Pittsburgh, Pa.

[21] Appl. No.: 437,969

[22] Filed: Nov. 16, 1989

[51] Int. Cl.[5] ..... F27B 7/24

[52] U.S. Cl. ..... 432/115; 432/242; 34/242; 227/152

[58] Field of Search ..... 432/115, 64, 242; 34/115, 242; 415/173 R; 277/152, 58

[56] References Cited

U.S. PATENT DOCUMENTS

| | | | |
|---|---|---|---|
| 3,012,765 | 12/1961 | Deussuer | 432/115 |
| 3,836,324 | 9/1974 | Shaefer et al. | 432/115 |
| 4,193,756 | 3/1980 | Leon | 432/115 |
| 4,283,064 | 8/1981 | Staab et al. | 227/152 |
| 4,295,824 | 10/1981 | Wens | 432/242 |
| 4,439,144 | 3/1984 | Mair | 34/242 |
| 4,457,520 | 7/1984 | Graachtrup | 432/242 |
| 4,728,289 | 3/1988 | Samena, Jr. | 432/242 |

*Primary Examiner*—Henry C. Yuen

*Attorney, Agent, or Firm*—Fred J. Baehr, Jr.

[57] ABSTRACT

A replaceable longitudinal seal for a rotary combustor formed from a circular array of pipes separated by perforated webs comprise a flat bar extending radially outwardly from ever other pipe with an angle bracket positioned on and welded to each flat bar so as to compensate for out of roundness of the combustor, a plurality of thin resilient strips of stainless steel removably fastened to each angle bracket and extending outwardly from said flat bar at an angle of approximately 60° and a plurality of arcuate shoes disposed proximate a circle scribed by the distal margins of said thin strips to form a dependable seal which will deflect when encountering debris on the shoes and portions thereof can be easily replaced if damaged by the debris.

8 Claims, 3 Drawing Sheets

4

REPLACEABLE LONGITUDINAL SEAL FOR A ROTARY COMBUSTOR

BACKGROUND OF THE INVENTION

This invention relates to a rotary combustor for burning municipal solid waste and more particularly to an improved longitudinal seal for the rotary combustor.

U.S. Pat. No. 4,728,289 describes a rotary combustor that includes a rotatable cylindrical drum having longitudinal or axial seals extending from the outer periphery of the drum, and sealing structures for forming passages for providing combustion fluids along portions of the rotatable cylindrical drum. Each sealing structure includes a movable shoe positioned along the periphery of a portion of the rotatable cylindrical drum, a support positioned at a predetermined distance from the axial seals along a portion of the periphery of the rotatable cylindrical drum, and first and second spring units coupled between the support and the movable shoe. The spring units urge the movable shoe into contact with at least one of the axial seals. As a result, an air seal is continuously provided between the axial seal and the movable shoe even though the rotary combustor expands and contracts with temperature.

SUMMARY OF THE INVENTION

Among the objects of the invention may be noted the provision of an axial seal that has a one time adjustment for out of roundness of the combustor barrel, can be replaced in small segments, is sufficiently flexible to pass large debris, and will provide a good seal.

In general, a replaceable longitudinal seal for a rotary combustor, when made in accordance with this invention, comprises a plate affixed to at least some of the pipes so as to extend radially outwardly therefrom, an angle bracket affixed to said plate in such a way as to compensate for out of roundness of said rotary combustor, a thin strip replaceably fastened to said angle bracket so that a distal margin thereof extends from said bracket and away from said rotary combustor and a plurality of shoes disposed longitudinally adjacent said rotary combustor, the distal margin of said thin strip being disposed to scribe a circle proximate the shoe to form a seal therebetween as the rotary combustor rotates, the width of the shoes being sufficient that the margin of the adjacent strip becomes proximate the shoe prior to the margin of the strip proximate the shoe moving away therefrom.

BRIEF DESCRIPTION OF THE DRAWINGS

The invention as set forth in the claims will become more apparent by reading the following detailed description in conjunction with the accompanying drawings, wherein like reference numerals refer to like parts through the drawings and in which:

DESCRIPTION OF THE PREFERRED EMBODIMENT

Figure 1:
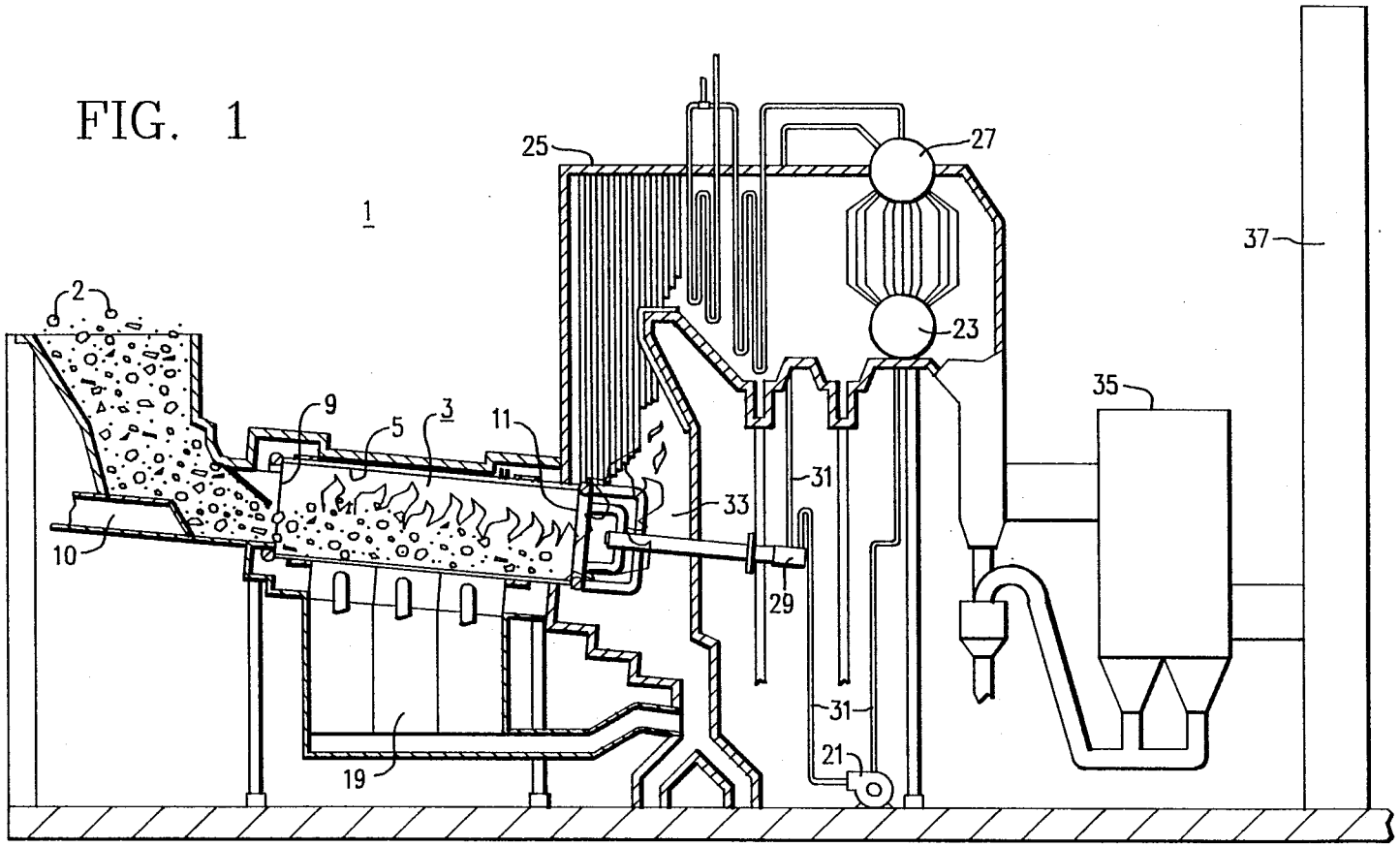
FIG. 1 is a schematic partial sectional view of a municipal solid waste disposal plant.

Referring now to the drawings in detail and in particular to FIG. 1, there is shown an incinerator 1 for burning municipal solid waste 2 in a rotary combustor 3. The rotary combustor 3 is formed from a circular array of tubes or pipes 5 with a plate or web 7 connecting adjacent pipes 5. The rotary combustor 3 is disposed to rotate on an inclined axis. Waste to be incinerated is fed into an upper or inlet end 9 of the combustor 3 by a ram 13 and tumbles toward a lower or outlet end 11 as the combustor 3 rotates on metal tires, which engage spaced apart rollers (not shown). The plates or webs 7 are perforated to provide holes or perforations 15 which allow combustion air supplied from plenum chambers 17 and 19 to enter the bottom portion of the rotary combustor 3. The burning tumbling waste 2 tends to ride up on one side of the combustor 3 as it rotates and the plenum chamber 17 there under is disposed to supply combustion air to the underside of the burning waste and is thus called the underfire plenum chamber 17 and the adjacent plenum chamber 19 is disposed to supply combustion air over the burning waste and is thus called the overfire plenum chamber 19. A cooling fluid, water, is circulated through the pipes 5 to keep them and the webs 7 cool and increase their useful life. The water is supplied from a pump 21, which takes its suction from a water drum 23 in a waste heat water wall boiler 25 and returns the heated cooling fluid to a steam drum 27 via a rotary joint 29 and associated piping 31. Unburnables, ash and hot gases exit from the lower end of the combustor 3, the hot gases and some fly ash flow upwardly in a flue portion 33 of the boiler 25, through a filter 35 such as a electrostatic precipitator or other filtering means which remove the ash and out a stack 37. The heavier ash and unburnables fall into the an ash removal hopper 39 in the bottom portion of the boiler 25.

Figure 2:
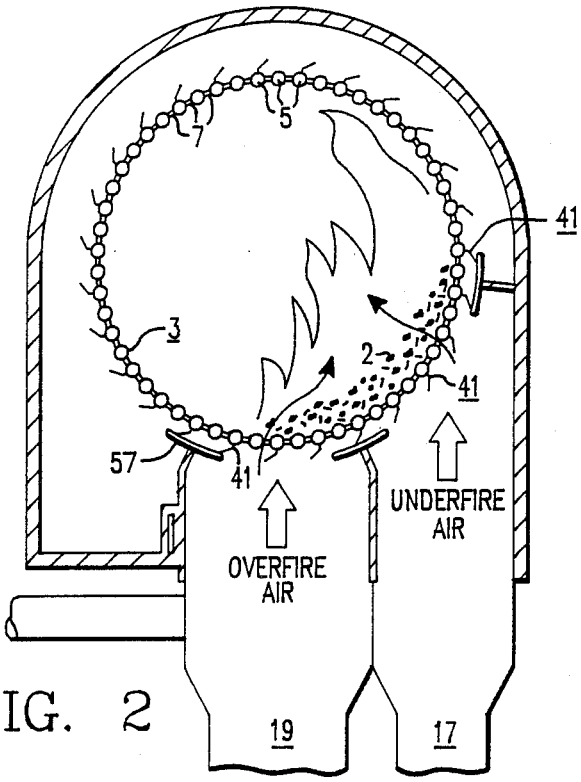
FIG. 2 is a partial sectional view taken on line II—II of FIG. 1.
Figure 3:
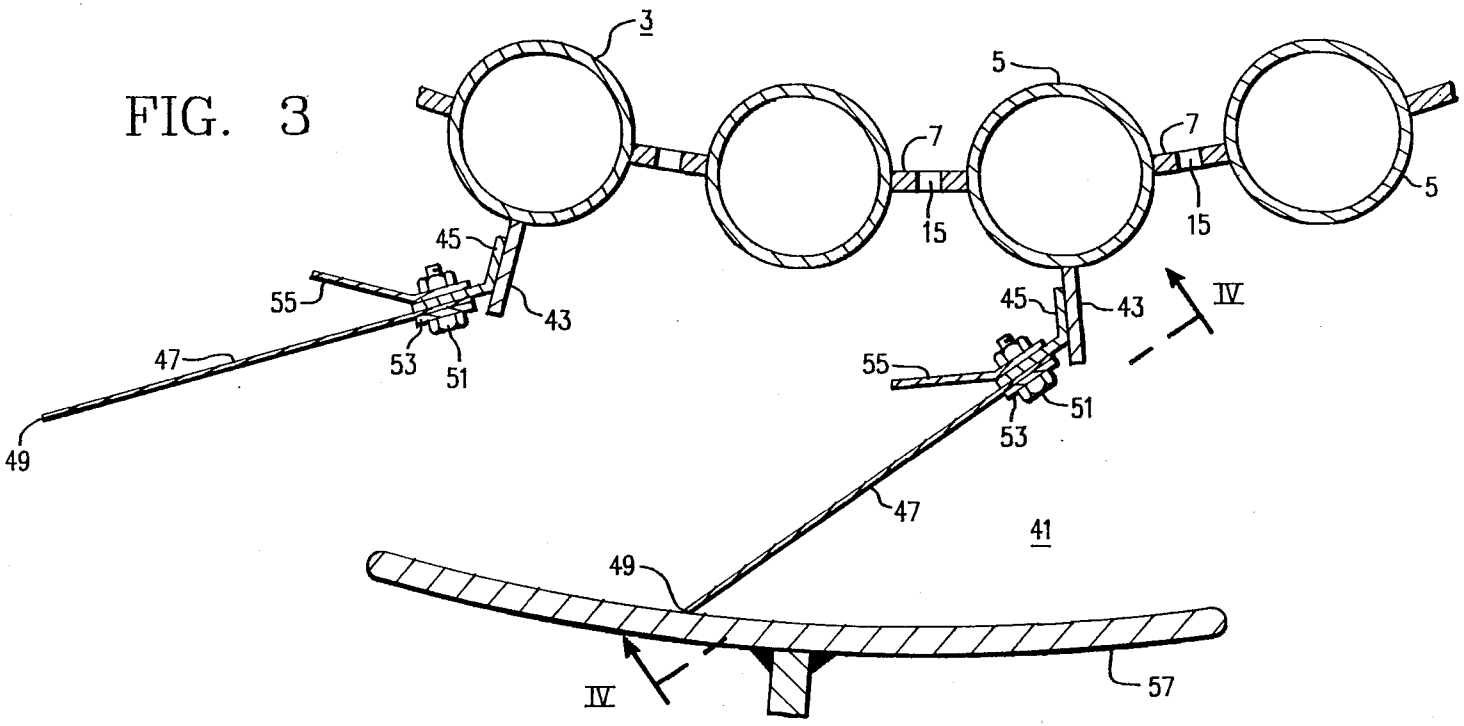
FIG. 3 is an enlarged sectional view of a portion of FIG. 2 showing the invention.

To provide efficient burning of the waste irrespective of it varying heat and moisture content, the underfire and overfire combustion air are controlled separately, thus requiring that a dependable axial or longitudinal seals 41 be disposed at the junctures of the plenum chambers 17 and 19 and the rotary combustor 3. The longitudinal seals 41, as shown best in FIGS. 2, 3 and 4, comprise a flat plate or bar 43 affixed longitudinally along the length of at least some of the pipes 5 so as to extend radially outward therefrom and an angle bracket 45 affixed to the flat plate 43 by welding. The bracket 45 is positioned on the flat plate 43 and moved radially inwardly or radially outwardly prior to welding to compensate for out of roundness of the rotary combustor 3. A thin strip 47 made of stainless steel or other resilient heat resistant material is replaceably fastened to the angle bracket 45 so that a distal margin 49 thereof extends from the angle bracket 45 and away from said rotary combustor 3 and forms and included angle of approximately 60° with respect to the flat plate 43. Bolts and nuts or other removable fasteners 51 and a backing bar 53 are utilized to fasten the thin strip 47 to the backing bar 45 so that it can be replaced relatively easily. A radiation shield 55 is fastened on the radial inner side of the angle bracket 45 by the bolts and nuts 51 to shield the thin strips 47 from radiant energy produced by the burning waste 2 and passing through the perforations 15 in the adjacent web 7 to prevent local heat induced distortion in the thin strips 47 opposite the perforations 15. A plurality of arcuate shaped shoes 57 are disposed longitudinally adjacent the rotary combustor 3. The distal margin 49 of the thin strip 47 are disposed to scribe a circle proximate the shoes 57 just clearing them to form a reliable rotatable longitudinal seal 41 adjacent the rotary combustor 3. The width of the shoes 57 is sufficient so that the margin 49 of an adjacent strip 47 is proximate the shoe 57 prior to the margin 49 of the thin strip proximate the shoe 57 moving away therefrom.

The strips 47 are resilient or spring like so that they will resiliently bend and pass over debris and obstructions such as solidified aluminum drips, which adhere to the shoes 57 without damaging the thin strip 47. However, if a thin strip should become damaged, they are made in relatively short segments so that any one of the segments can be easily replaced.

Figure 4:
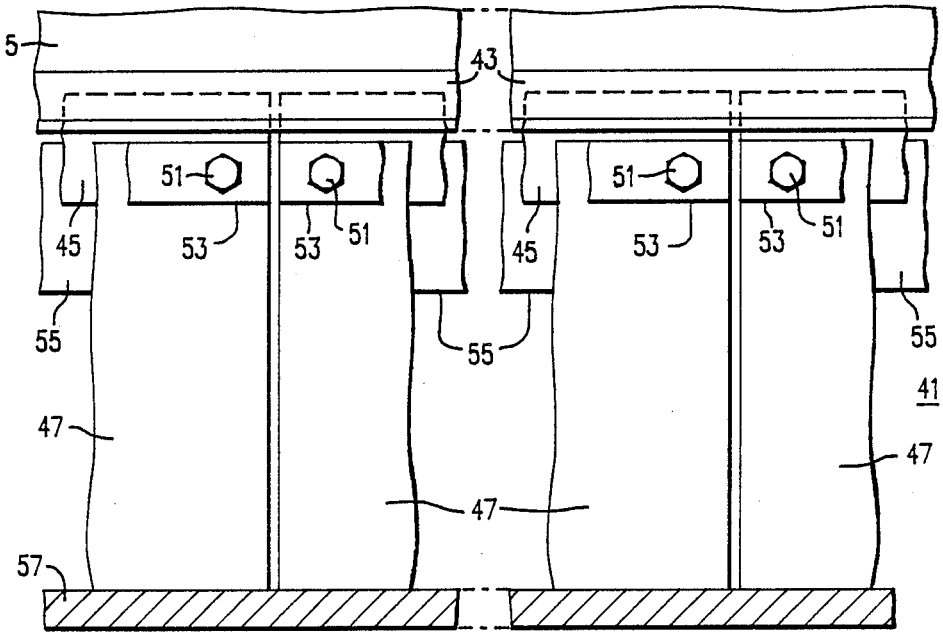
FIG. 4 is a sectional view taken on line IV—IV of FIG. 3.

As shown in FIG. 4, the flat plate or bar 43 is preferably made in one piece, while the angle bracket 45 is made in two pieces to facilitate installation in the field. The thin strip 47, backing bar 53 and thermal shields 55 are made in short segments to facilitate removal and replacement if a segment should become damaged and to prevent them from jamming the ash removal equipment if one should somehow break off.

The thin strips also have the advantage of flexing and dislodging aluminum drips adhering to the leading side thereof. Aluminum present in the waste 2 being burned in the rotary combustor 3 melts and begins to drip through the perforations 15 disposed at about the four o'clock location and tend to solidify in globs on the leading side of the thin strips 47. As the globs come in contact with a shoe 57 the thin strips 47 resiliently bend allowing the glob to pass over the shoe 57 and this resilient bending of the thin strips 47 also breaks the bond formed as the aluminum solidifies on the leading side thereof and the dislodged solidified aluminum globs fall into the bottom of the plenum chamber and are removed when the unit is shut down.

While the preferred embodiments described herein set forth the best mode to practice this invention presently contemplated by the inventors, numerous modifications and adaptations of this invention will be apparent to others skilled in the art. Therefore, the embodiments are to be considered as illustrative and exemplary and it is understood that numerous modifications and adaptations of the invention as described in the claims will be apparent to those skilled in the art. Thus, the claims are intended to cover such modifications and adaptations as they are considered to be within the spirit and scope of this invention.

What is claimed is:

1. A longitudinal seal for a rotary combustor formed from a circular array of pipes with a web between adjacent pipes, the web being perforated to supply combustion air to the combustor, said seal comprising a plate affixed to at least some of the pipes so as to extend radially outward therefrom, an angle bracket affixed to each of said plates in such a way as to compensate for out of roundness of said rotary combustor, a thin strip replaceably fastened to each of said angle brackets so that a distal margin thereof extends from said bracket and away from said rotary combustor and a plurality of shoes disposed longitudinally adjacent said rotary combustor, the distal margin of said thin strips being disposed to scribe a circle proximate said shoes to form a seal therebetween as the rotary combustor rotates, the width of the shoes being sufficient that the margin of the adjacent strip becomes proximate the shoe prior to the margin of the thin strip which was proximate the shoe moving away therefrom a radiation shield fastened to a radially inner side of the angle brackets to protect the thin strips from radiant energy emitted from the burning waste which pass through perforations in the adjacent webs, wherein a plurality of thin strip segments are disposed longitudinally along each of said angle brackets.

2. The longitudinal seal of claim 1, wherein the thin strips are generally disposed to form an included angle of about 60° with respect to the associated plate.

3. The longitudinal seal of claim 1, wherein the thin strips are formed of stainless steel.

4. The longitudinal seal of claim 1, wherein the plates are welded to the pipes.

5. The longitudinal seal of claim 1, wherein the angle brackets are welded to the plates.

6. The longitudinal seal of claim 1, wherein the thin strips are removably fastened to the angle brackets with fasteners.

7. The longitudinal seal of claim 1, wherein the thin strips are fastened to the angle brackets with nuts and bolts, whereby they can be easily replaced.

8. The longitudinal seal of claim 1, wherein the radiation shield extends from the angle bracket in a general chordal direction and extend beyond the perforations in the adjacent web.

* * * * *